United States Patent [19]

Borgia, V

[11] Patent Number: 4,493,396

[45] Date of Patent: Jan. 15, 1985

[54] WINCH FOR SAFELY LOWERING A PERSON AT A CONTROLLED RATE

[76] Inventor: Joseph Borgia, V, 2723 Riverview Dr., Naples, Fla. 33942

[21] Appl. No.: 475,253

[22] Filed: Mar. 14, 1983

[51] Int. Cl.[3] ..... A62B 1/12

[52] U.S. Cl. ..... 182/238; 182/233

[58] Field of Search ..... 182/238, 233, 239, 236, 182/234, 75, 231, 5, 72; 188/85, 71.1

[56] References Cited

U.S. PATENT DOCUMENTS

| | | | |
|---|---|---|---|
| 570,151 | 10/1896 | Berez | 188/85 |
| 1,016,859 | 2/1912 | Walters | 182/236 |
| 1,203,467 | 10/1916 | Berg | 182/238 |
| 1,333,530 | 3/1920 | Atamian | 182/239 |
| 1,500,943 | 7/1924 | Jolkovski | 182/239 |
| 2,270,586 | 1/1942 | Jahant | 188/85 |
| 3,834,671 | 9/1974 | Du Mesnil | 182/233 |
| 3,850,263 | 11/1974 | Chin | 182/236 |
| 3,861,496 | 1/1975 | Hoover | 182/73 |
| 4,253,643 | 5/1981 | Forester | 182/239 |
| 4,287,963 | 9/1981 | Coxsey | 182/236 |
| 4,327,818 | 5/1982 | Tepsa | 182/233 |
| 4,367,863 | 1/1983 | Dulondel | 182/85 |
| 4,416,351 | 11/1983 | Geurtsen | 182/238 |

*Primary Examiner*—Reinaldo P. Machado
*Assistant Examiner*—Alvin Chin-Shue
*Attorney, Agent, or Firm*—Merrill N. Johnson

[57] ABSTRACT

A winch for use in safely lowering a person from an elevated position comprising a cylindrical casing, a rotatable shaft mounted on a pair of bearings located in the casing, a spool affixed to the shaft, a cam plate affixed to the shaft, a brake disc affixed to the shaft, a first gear affixed to the shaft, an air pump having a piston rod activated by the cam plate, a disc brake assembly activated by the air pump, a cable wound upon the spool, a centrifugally operated clutch mounted on the casing including a second gear meshed with the first gear, and means including a crank attached to one end of the shaft for rewinding the cable onto the spool.

3 Claims, 2 Drawing Figures

WINCH FOR SAFELY LOWERING A PERSON AT A CONTROLLED RATE

BACKGROUND AND SUMMARY OF THE INVENTION

I have intended a unique winch for use in safely lowering a person from an elevated position such as the window of a high rise building when a fire or other emergency prevents use of elevators and other usual exits.

As the result of a fire or other emergency, the elevators and stairwells of a high rise building may be unusable. In the past a number of devices have been suggested for lowering persons trapped in the upper floors of a burning high rise building to the ground. See, for example, U.S. Pat. Nos. 1,203,467; 3,850,263; 3,861,496; 4,253,643; 4,287,963; and 4,327,818.

However, as can be seen from the foregoing patents, the state of the art does not include a small, self-contained device which can be carried into the building by one person such as an overnight hotel guest, a device whose working parts are protected by a casing, and a device providing two independent safety mechanisms to assure that the person being lowered to the ground is lowered at a safe, automatically controlled rate of descent.

My invention provides a compact, relatively inexpensive and portable winch which can be affixed to a hook or other secure fitting at or near the window opening to provide for the prompt descent of one or more persons from the upper floor of a high rise building.

The winch which I have invented includes two separate but cooperating mechanisms to guarantee that the person being lowered to safety will descend at a safe and controlled rate. In the preferred form of my invention, these cooperating mechanisms are a cam operated disc brake and a gear driven centrifugally operated clutch.

Briefly stated, my unique winch comprises:

a drum-shaped cylindrical casing;

a rotatable shaft within the casing mounted on a pair of bearings located on opposite sides of the casing;

a spool axially affixed to the shaft;

a cam plate affixed to the shaft;

a brake disc affixed to the shaft;

a first gear affixed to the shaft;

an air pump mounted on the casing and having a piston rod accuated by the rotation of the cam plate;

a disc brake assembly activated by the air pump;

a cable wound upon the spool;

a centrifugally operated clutch mechanism mounted on the casing and including a second gear meshed with the first gear; and means including a crank attached exteriorly of the casing to one end of the shaft for rewinding the cable onto the spool.

DETAILED DESCRIPTION OF THE INVENTION

Figure 2:
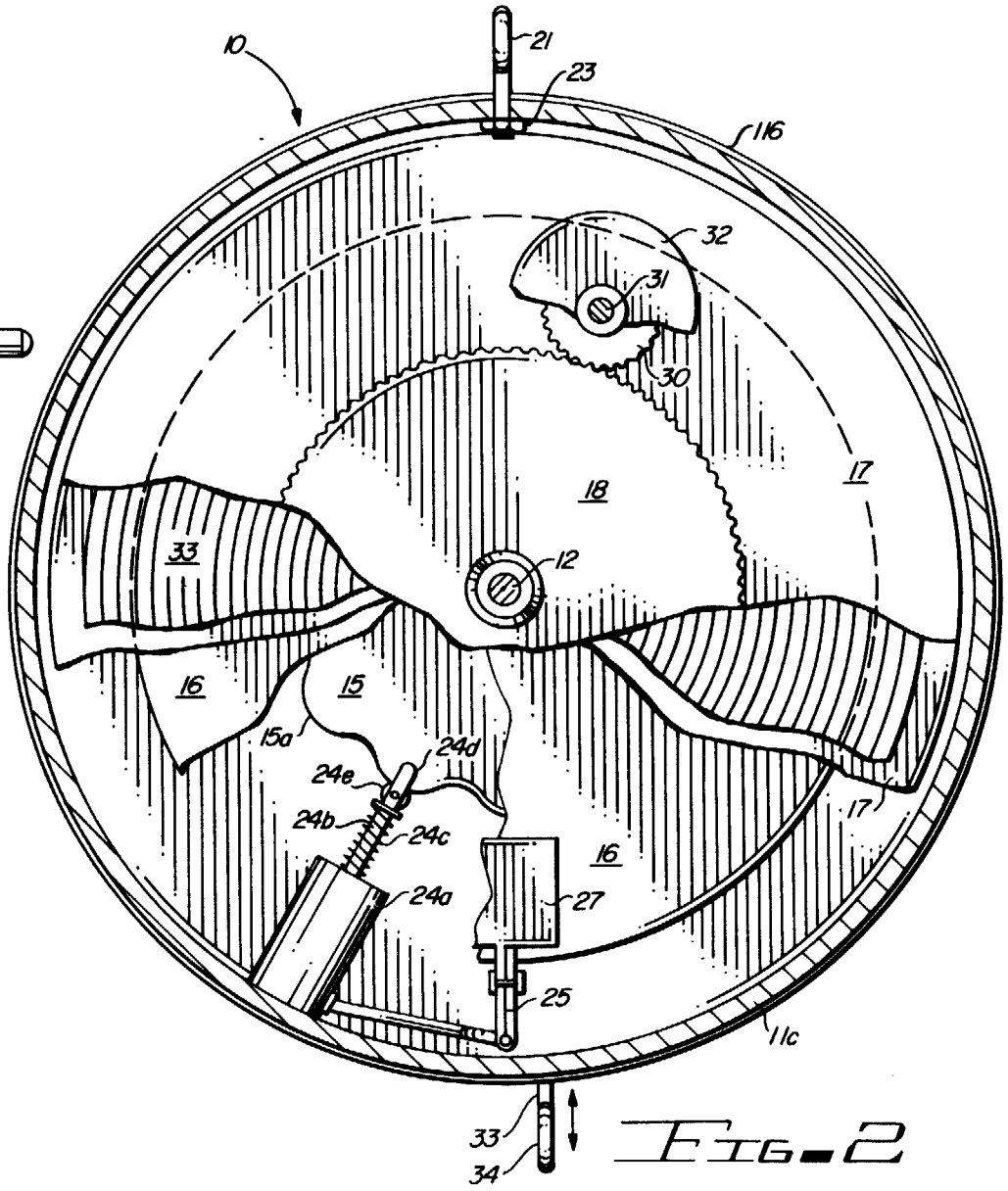
FIG. 2 is a cross-sectional side view taken along line 2—2 of FIG. 1 with portions of one gear, the spool and the brake disc broken away to show the cam operated disc brake assembly.
Figure 1:
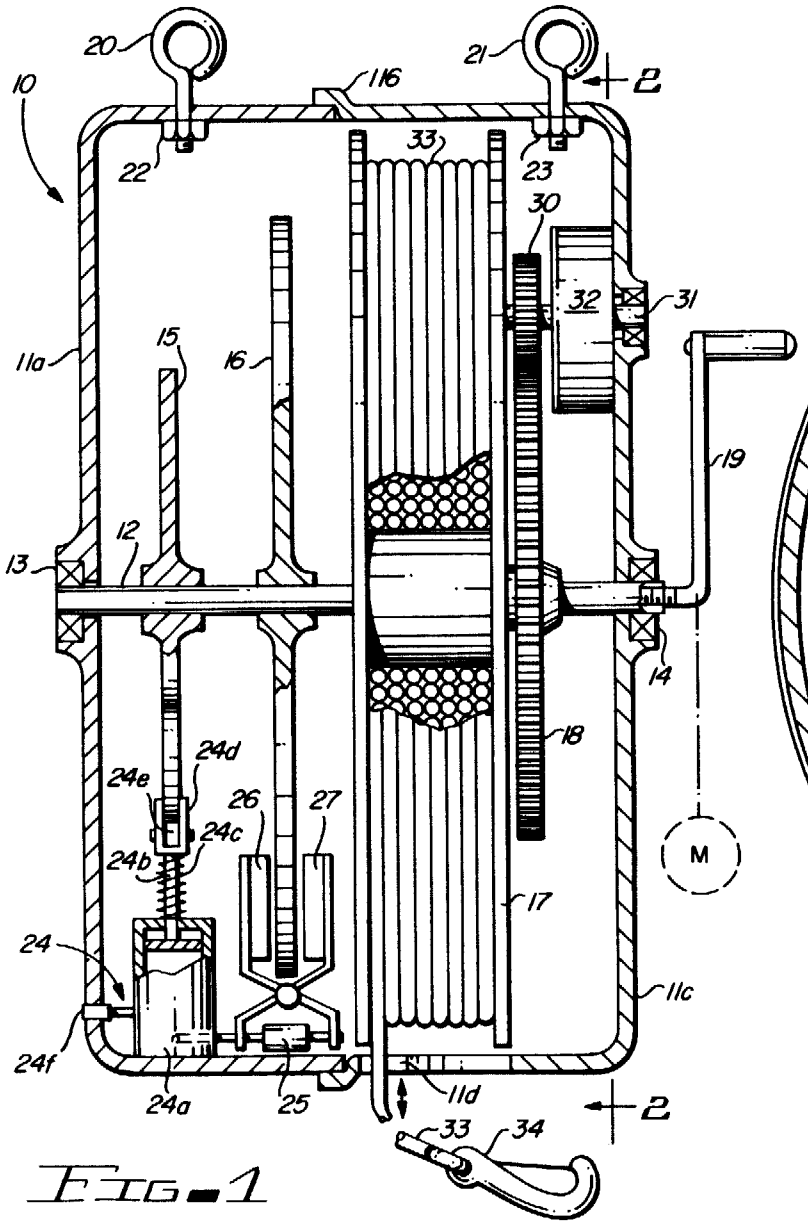
FIG. 1 is an end view partially in section across a diameter of the cylindrical casing showing all the elements of my invention.

Referring to the drawings, FIGS. 1 and 2 show two views of a preferred form of my invention. The winch includes a two-part cylindrical casing 10 formed by casing member 11*a* whose outer edge is pressed into the raised rim 11*b* of casing member 11*c*.

Casing 10 preferably is made of forged or cast steel. The assembled casing has an overall diameter of approximately 12 inches and an overall width of approximately 8 inches. The winch is of such size that with its hand crank removed, it can be conveniently carried in a small case or container by a hotel guest or similar person as part of his luggage.

A cylindrical shaft 12 is rotatably journalled on a pair of bearings 13 and 14 mounted axially within casing members 11*a* and 11*c* respectively. Four cooperating members are affixed to shaft 12 and rotate with the shaft: a cam plate 15; a brake disc 16; a spool 17; and a gear 18. In addition, one end of shaft 12 is axially bored and threaded so that a hand-operable crank 19 can be attached to rotate the shaft.

Cam plate 15 has a scalloped sinesodal curved outer edge which in its preferred form includes sixteen apexes 15*a* as shown in FIG. 2. Disc brake 16 has two parallel opposite surfaces for engagement with the pads of a disc brake assembly. Spool 17 is designed to receive a coil of cable.

A pair of eyebolts 20 and 21 are attached to casing members 11*a* and 11*b* respectively by nuts 22 and 23 as best shown in FIG. 1. Eyebolts 20 and 21 are used to suspend or secure the winch to the building from which escape is desired, as will be more fully explained hereafter.

An air pump 24 is mounted on casing member 11*a* as shown in FIG. 1. Air pump 24 includes an air cylinder 24*a*, a piston rod 24*b*, a coiled spring 24*c*, and a forked cam guide 24*d* rotatably supporting a circular roller 24*e* in engagement with the outer edge of cam plate 15. Air cylinder 24*a* also includes a pressure relief valve 24*f* vented through the side of casing 11*a* as best shown in FIG. 1.

In operation, as shaft 12 rotates the cam plate 15 will rotate with it. Rotation of cam plate 15 causes the reciprocation of piston rod 24*b* against the action of spring 24*c*. This causes increasing compression of the air within cylinder 24*a*.

Air cylinder 24*a* is connected to a disc brake assembly which includes a disc brake air cylinder 25 and a pair of disc brake pads 26 and 27. Increasing air pressure within air cylinder 24*a* causes the piston rod within air cylinder 25 to move and this movement forces brake pads 26 and 27 into engagement with the opposite surfaces of brake disc 16. The faster cam plate 15 rotates, the greater the braking pressure applied to brake disc 16, thus providing a controlled rate of rotation of shaft 12.

The teeth of gear 18 affixed to shaft 12 are designed to mesh with the teeth of a much smaller gear 30. Gear 30 is affixed to shaft 31 of a centrifugally operated clutch mechanism 32. Clutch mechanism 32 is rigidly mounted onto the side of casing member 11*c* as shown in FIG. 1.

In operation, as shaft 12 rotates the rotation of large gear 18 on the shaft will cause much faster rotation of gear 30, which in turn energizes centrifugal clutch 32. The faster the shaft rotates, the greater the engagement of centrifugally operated clutch 32, causing a braking action which slows down the rate of rotation of shaft 12.

An extended length of cable 33 is wound upon spool 17 with the outer end of cable 33 protruding through hole 11*d* in casing member 11*c*. A hook 34 is attached to the end of cable 33 outside of casing 10.

My winch with its hand crank removed will fit into an easily portable case which can be brought into a high rise hotel room by an overnight guest. The case preferably also includes the hand crank and a body harness designed to support the person being lowered to safety. Or the winch can be permanently kept in the room ready to be used in case of a fire or other emergency. In either event, the ends of a cable (not shown in the drawings) are secured to eyebolts 20 and 21 so that the winch can be quickly suspended from or attached to the window frame of the high rise building from which escape is desired.

With the winch secured in place for use, the person to be lowered to safety dons a body harness such as harness 29 shown in U.S. Pat. No. 4,287,963. A ring fastened to the harness is attached to hook 34 of the winch and the person is ready to descend. The person then steps through the window opening to safety at a controlled rate.

When the person reaches ground level, he can quickly shed the body harness and the cable can be rewound upon the spool of the winch by hand crank 19. Alternatively, in order to speed the rewinding of the cable, a motor such as motor M shown in dotted lines in FIG. 1 may be attached to shaft 12 rather than using hand crank 19.

I have shown and described a preferred form of my invention. Changes and modifications of my winch will, of course, be apparent to those skilled in the art. The scope and spirit of my invention is limited only by the following claims.

I claim:

1. A self-contained compact winch for use in safely lowering a person from an elevated position comprising:

a drum-shaped cylindrical casing;

a rotatable shaft within the casing mounted on a pair of bearings located on opposite sides of the drum-shaped casing;

a spool axially affixed to the shaft;

a cam plate axially affixed to the shaft;

a brake disc axially affixed to the shaft;

a first gear axially affixed to the shaft;

an air pump mounted on the inside of the casing and having a piston rod actuated by the rotation of the cam plate;

a disc brake assembly within said casing activated by the air pump engage said brake disc;

a length of cable wound upon the spool with the free end of said cable depending from a hole in said casing;

a centrifugally operated clutch mechanism mounted on the inside of the casing and including a second gear meshing with the first gear; and means including a crank attached exteriorly of the casing to one end of the shaft for rewinding the cable onto the spool.

2. A winch according to claim 1 wherein the cam plate has a sinesodally curved outer surface.

3. A winch according to claim 2 wherein the curved outer surface of the cam plate includes sixteen apexes.

* * * * *